United States Patent [19]

Lachmann

[11] Patent Number: 4,856,733

[45] Date of Patent: Aug. 15, 1989

[54] METHOD AND ARRANGEMENT FOR DETERMINING PASSAGE THROUGH AN APOGEE

[75] Inventor: Karl-Heinz Lachmann, Lauf/Pegn., Fed. Rep. of Germany

[73] Assignee: Diehl GmbH & Co., Nuremberg, Fed. Rep. of Germany

[21] Appl. No.: 191,588

[22] Filed: May 9, 1988

[30] Foreign Application Priority Data

May 18, 1987 [DE] Fed. Rep. of Germany ..... 3716606

[51] Int. Cl.[4] ..... F41G 7/00

[52] U.S. Cl. ..... 244/3.15

[58] Field of Search ..... 244/3.15, 3.21, 3.1

[56] References Cited

U.S. PATENT DOCUMENTS 3,332,642 7/1967 Halling ..... 244/3.15

4,606,514 8/1986 Sundermeyer ..... 244/3.15

OTHER PUBLICATIONS

Chapters 1 and 4 of "Parameteradaptive Regelalogorithmen fur bestimmte Klassen nincht-linearer Prozesse mit eindeutigen Nichtlinearitaten" (Progress Reports from the VDI-Journals, Series 8, No. 66, 1983).

*Primary Examiner*—Charles T. Jordan

*Attorney, Agent, or Firm*—Scully, Scott, Murphy & Presser

[57] ABSTRACT

A method for the on board determination for the passage through an apogee by a ballistically launched projectile through the receipt and comparison of a sequence of measured values vacillating or fluctuating specifically relative to the trajectory. Also disclosed is an arrangement for the on board determination of the point in time of an apogee of a projectile which is launched in a ballistic trajectory, through the receipt and comparison of a sequence of measured values vacillating specific to the trajectory.

10 Claims, 3 Drawing Sheets

METHOD AND ARRANGEMENT FOR DETERMINING PASSAGE THROUGH AN APOGEE

BACKGROUND OF THE INVENTION

1. Field of the Invention

The present invention relates to a method for the on board determination of the passage through an apogee by a ballistically launched projectile through the receipt and comparison of a sequence of measured values vacillating or fluctuating specifically relative to the trajectory. Moreover, the invention is also directed to an arrangement for the on board determination of the point in time of an apogee of a projectile which is launched in a ballistic trajectory, through the receipt and comparison of a sequence of measured values vacillating specific to the trajectory.

2. Discussion of the Prior Art

Measurements of that type, which are under consideration herein, have become known from the disclosure of U.S. Pat. No. 4,606,514 or from U.S. Pat. No. 3,332,642, wherein the change over time in the measured values of pressure or acceleration are observed on board the projectile, which values pass through an extreme value at the apogee of a ballistic trajectory, wherein the differential quotient thereof becomes zero in the apogee.

That type of determination of the apogee is always quite inaccurate, especially for gently sloped or curving trajectories, which do not possess a geometrically highly distinct apogee; and especially from those types of measurements, only relatively late after the actual passage through the apogee, along the leg of the already again descending curve of the trajectory, can there be derived the determination that the apogee has already been traversed. However, inasmuch as the mode of operation of an autopilot which is intended to steer a ballistically fired projectile after passage through the apogee into a gliding trajectory of predetermined geometry, which at a defined point in time along the ballistic trajectory necessitates a given spatial pitch position as a positional reference for regulating the flight, and inasmuch as the simplest obtainable positional reference represents the horizontal position of the longitudinal axis of the projectile at the point of the apogee, for attaining a precise function of the autopilot, an effort is made to achieve the precisest possible determination of the point in time for the apogee (with transmission of the momentary system position as a horizontal-positional reference to the autopilot).

SUMMARY OF THE INVENTION

Accordingly, in recognition of these conditions, it is an object of the present invention that with a representable increase in demand on sensor and data processing on board the projectile, it is possible to attain a substantially more precise determination of the relative point in time of the apogee along the ballistic trajectory.

The foregoing object is inventively achieved through a method of the type as described herein, whereby after the reaching of a stable condition of flight along the ballistic trajectory, there are repeatedly ascertained changes in measured values of the environment or system, which are dependent upon the trajectory, in which the changes in the measured values are compared with changes which are predicted from a mathematical-parametric model of the behavior of the projectile, wherein the parameters of the model are correlated with the actual movement of the projectile on the basis of the actual development of the measured values, and wherein the point in time of the passage through the apogee of the ballistic trajectory is calculated from the model with the recursively correlated parameters.

Furthermore, the object is inventively achieved through an arrangement of the type as described herein through the provision of a computer circuit with a model pertaining to the expected projectile movement along the ballistic trajectory, as well as a polynomial comparator (equation solver) for the open system parameter (coefficients r) of the model curve or plot, which is supplied with measured values (x) from the environmental or system behavior sensors for the adaptive correction of the pre-estimated or assumed system parameters pursuant to the measure of the actual ballistic-kinematic behavior of the projectile.

Thereby, the inventive object for the determination of the point in time of the apogee at the ballistic starting trajectory of a steered or guided projectile is predicted on a parameter-estimation method on the basis of system and/or environmental measured value sequences which are determined on board the projectile; whereby the measured changes in the measured values are compared with pre-estimated changes in (relative) measured values pertaining to the behavior of the projectile from a mathematical model. Thus, on board the projectile, commencing from actually determined changes in the measured values, with the measured value-gradients as a function of time, there is carried out a prediction of the measured value sequence corresponding to the ballistic trajectory in conformance with the methods of the recursive parameter-estimating procedure, as is generally described in greater detail in Lachmann "Parameteradaptive Regelalgorithmen fur bestimmte Klassen nicht-linearer Prozesse mit eindeutigen Nichtlinearitaten" (Progress Reports from the VDI-Journals, Series 8, No. 66, 1983), especially Chapt. 4 "Rekursive Parameterschatzung im parameter-adaptiven Regelkreis".

Thus, during the flight, the plotted path which is predicted (expected) from investigations or model considerations, is adaptively correlated with the actual momentarily measured plotted path or trajectory on the basis of the altitude-dependent changes in measured values; and from the mathematical description of the actually traversed trajectory which is hereby available on board the projectile, there can be computed the (still aheadlying or even passed through) time period pertaining to the passing through of the apogee. The heretofore relatively undefined result in the measurement of the apogee is thusly replaced, pursuant to the inventive method, by a clearly calculated point in time for the apogee.

The different influencing magnitudes on the measured values which are predicated on the adaptation of the plotted trajectories can always require differently computer-obtained points in time for the apogee. Pursuant to an expedient modification of the inventive object, that particular point in time for the apogee which is obtained from the adapted plotted trajectory equation is employed as the basis for the further function of the projectile autopilot, which results from statistical considerations of the differently computed points in time for the apogee as the most probable or likely point in time for the apogee.

Whereas the processing of the measured magnitudes can be carried out in a signal processor, it is expedient that the adaptation of the actually traversed trajectory which is based on a recursive parameter estimation be carried in the anyway available autopilot, inasmuch as for the control sequences thereof, there is already stored a mathematical model with regard to the ballistic-dynamic behavior of the projectile, which can be immediately actualized in this manner in conformance with the actual behavior of the projectile.

BRIEF DESCRIPTION OF THE DRAWINGS

Additional alternatives and modifications, as well as further features and advantages of the invention can now be readily ascertained from the following detailed description of an exemplary embodiment thereof, taken in conjunction with the accompanying drawings; in which.

DETAILED DESCRIPTION

Figure 1:
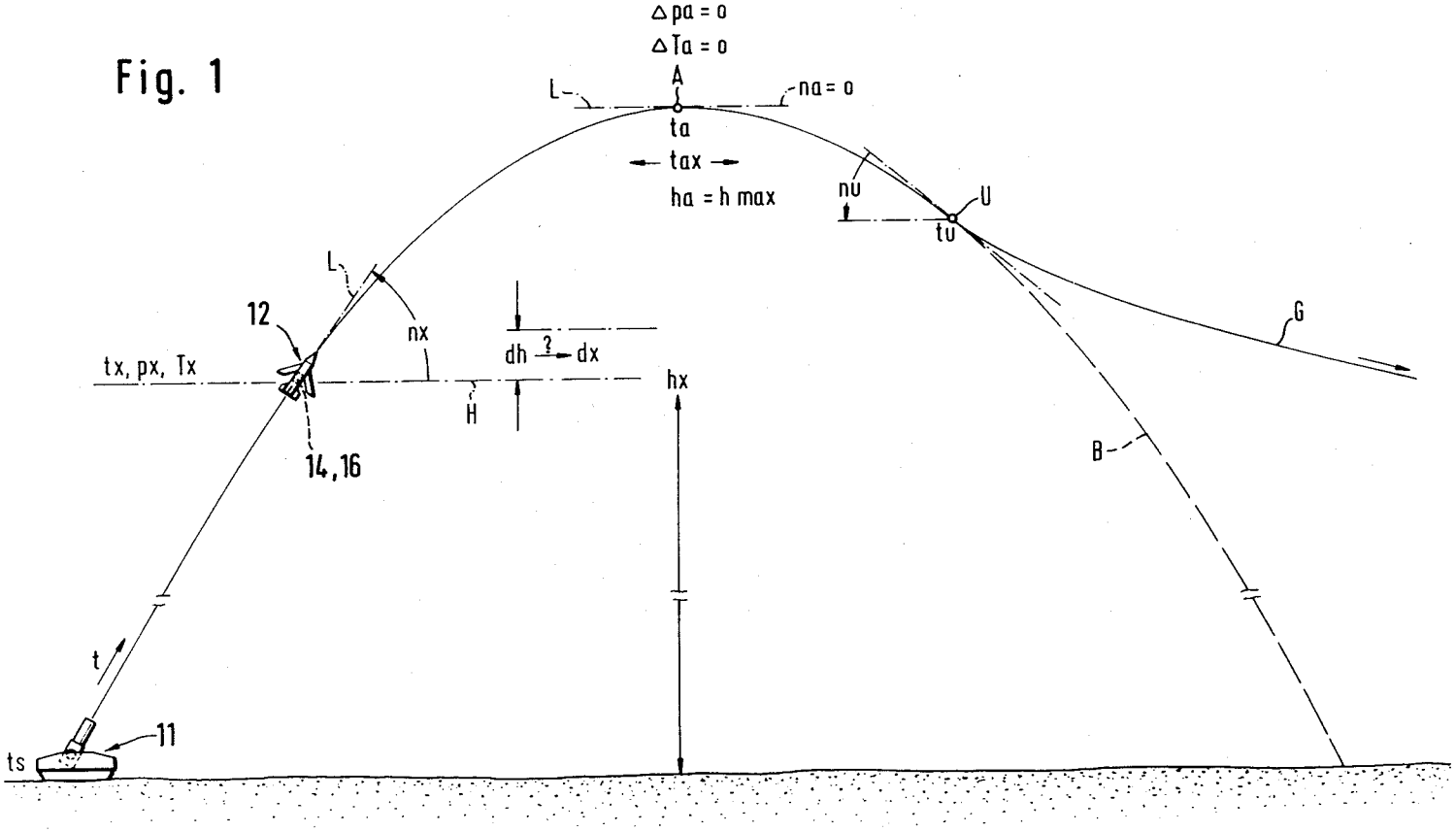
FIG. 1 illustrates a generally diagrammatic elevational view in the pitch plane of the transition of a ballistic firing trajectory of a guided projectile into an extended gliding trajectory.

The ballistic trajectory B of a projectile 12 which is fired from a launch tube or weapon barrel 11 essentially determines itself from the firing charge and the firing elevation at the starting timepoint ts. With the knowledge of these starting conditions there can be resultingly determined the apogee location A and the point in time $t_a$ of the passage through the apogee. Therefrom, in turn, there can again be extrapolated the optimum change-over timepoint tu, in which there is to be effected a transition from the essentially ballistic pattern of flight of the projectile 12 into an extended, essentially more gently guided gliding trajectory G; from which there is then carried out the scanning of the target terrain for a target object (not shown) which is finally to be attacked. For this transition in the trajectories at the change-over point U from the ballistic trajectory B, which is automatically carried out through the program control and regulating function of an autopilot on board the projectile 12, this necessitates an inertial pitch position-angle reference; in effect, the knowledge with respect to the pitch position angle nu in space which has actually been assumed by the projectile 12 (in essence, relative to the horizontal H) at a certain timepoint t along the ballistic trajectory B prior to reaching that change-over point U. Particularly adapted as such a positional reference for the function of the autopilot is the parallel position of the longitudinal axis L of the projectile relative to the horizontal H, which is assumed an extremely good approximation at the passage of the projectile through the ballistic apogee A. As reference magnitude for the spatial pitch regulation for the autopilot there is accordingly transmitted thereto the output signal n of a pitch-rotational rate gyro 13, which is already provided in the autopilot, at the point in time of the passage ta through the apogee, as the horizontal H. Relative to this reference position, there is obtained from the mathematical interrelationship of the ballistic trajectory B, the actually given pitch position angle nu at the change-over timepoint tu.

In order to afford for the transition into the gliding path G pursuant to the prescribed trajectory guidance, it is intended to obtain the most possibly accurate determination in the timepoint ta for the apogee; and namely, at a determination of the information which are available on board the projectile 12, without necessitating any manual data to be introduced for characterizing the actual ballistic trajectory B during the hectic procedure in the firing. As a result thereof, on board the projectile 12 after the latter has reached a stable condition of flight, there are obtained and evaluated sequences of measured values x, hose change x(t) over time, because of physical grounds (system-required or environmentally-required), depend upon the momentarily reached point along a ballistic trajectory B. Such measured values x in the surroundings (outside) of the projectile 12 are, for example, the barometric (altitude-dependent) pressure p or the outside temperature T which fluctuates over the altitude h, since these trajectory-dependent and thereby time dependent measured value x(t) evidence both at the zenith or apogee point A of the trajectory B; meaning, that the first differential quotient after the time becomes zero at the apogee A. As the here socalled system measure value x which is based on the kinematic behavior of the projectile 12 itself, there is in particular adapted the information with respect to the pitch angle-rotational rate dn which is delivered by the pitch-rotational rate gyro 13.

It is advantageous that there is no requirement for an absolute determination of the measuring timepoints tx, and also no absolute determination of the measured values x, inasmuch as this only relates to a certain behavior of the change dx in the measured value at a defined relative point in time ta, from which there can then be measured the time period up to the reaching of the pregiven changeover timepoint tu (relative to the passage through the apogee at the timepoint in time ta).

Preferably, there are determined and evaluated different measured values x, which then always lead to a dispersion of the obtained apogee timepoints tx in dependence upon the different environmentally influencing magnitudes, and lead from the steepness of the ballistic trajectory B. However, from this dispersion of the values tax, by means of the usual statistical methods such as the formation of the center of gravity, more precise conclusions can be drawn over the actual timepoint ta for the apogee. Such a median value formation can be carried out already before reaching the apogee point A through calculatedly extrapolated apogee timepoints tax; however, it would also be sufficient, from the actually encountered fluctuation tax after passage through the apogee A, that by means of the known mathematical laws or interrelationships of the movement along a ballistic trajectory B, to calculate back over time along the already completed passage through the timepoint ta of the apogee, and thereby the past point in time ta, and to read out the stored pitch position angle na associated with that past timepoint ta as the positional reference for the autopilot.

Figure 2:
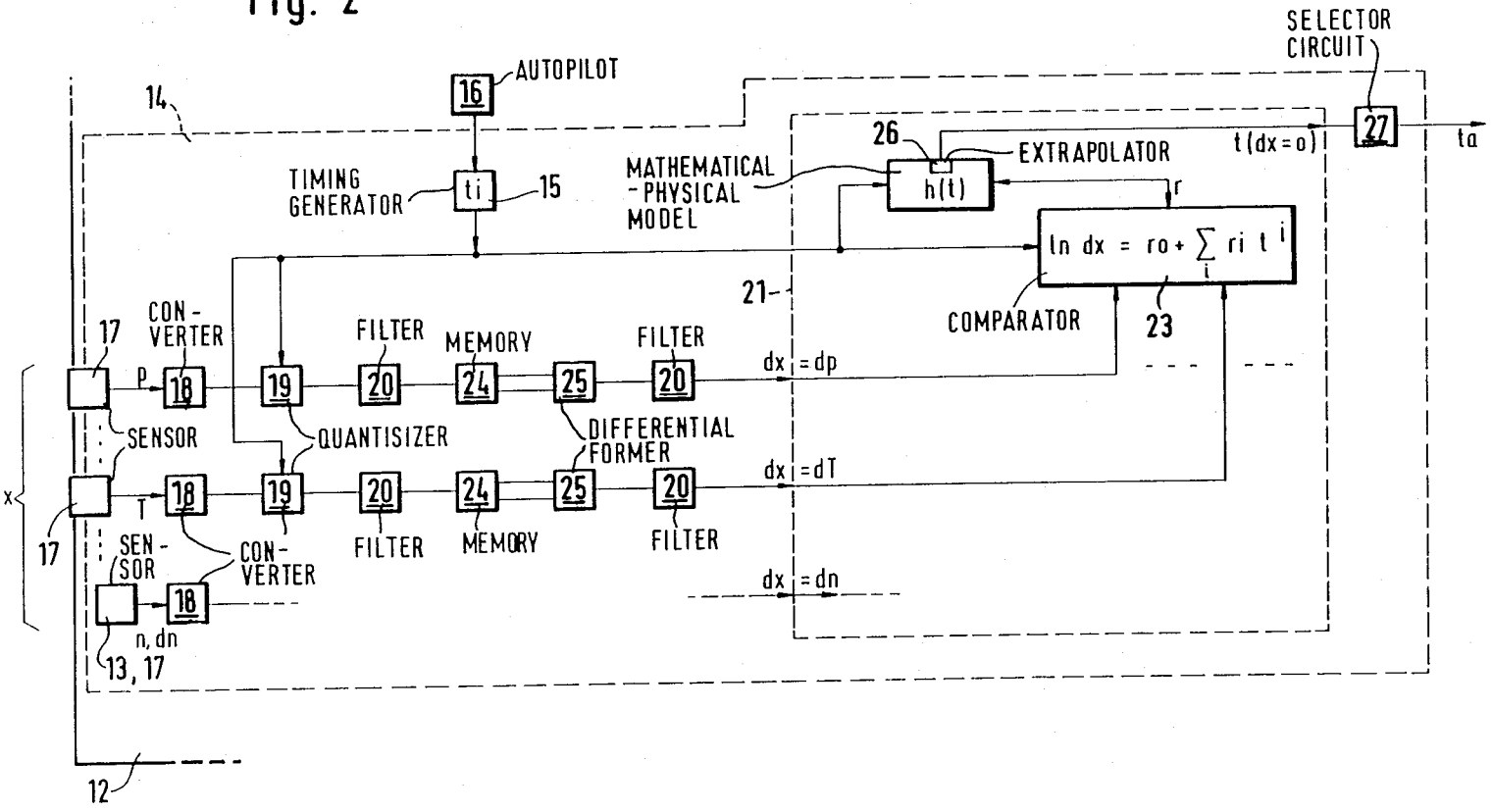
FIG. 2 illustrates a considerably simplified block circuit diagram of the determination of the passage through the apogee of the ballistic trajectory.

Referring to FIG. 2, the projectile 12 is also equipped with an evaluating or analyzing installation 14, whose function is released, for example, through its timing generator 15, when the projectile 12 flies in a ballistically stable mode subsequent to the firing; whereby this actuation; for example, can be carried out by an autopilot 16 which is already present on board such a guided or steered projectile 12. For the obtention of environmental measured values x, the projectile 12 is equipped with sensor 17; for example, for determining the outside barometric pressure p and/or the outside temperature T (both of which fluctuate in dependence upon the momentary altitude of flight H). Converters or transponders 18 delivers output magnitudes which are proportional to the measured values, which magnitudes; for instance, controlled by the timing generator 15, are periodically scanned and digitalized in quantisizers 19, and cleansed from measuring noises by subsequently connected filters 20.

In a computer circuit 21 there is implemented a mathematical-physical model 22 with respect to the movement over time, especially the altitude of flight H (t), of the projectile 12 along its ballistic trajectory B. Due to the known physical interrelationships, a certain change in elevation dh must correspond to a certain change dx in a measured value, which is valid for the logarithmetic dependence which is directly storable as a polynome. From memories or storages 24 there are consequently transmitted successive measured values xi into differential formers 25 which, possibly through further filters 20, emit the actually determined change dx in the measured value with regard to the previously obtained measured value x. The polynomial coefficients r which can be computed for this change are represented in comparator 23 in comparison with the coefficients r which are delivered from the model 22; and upon deviations, the coefficients r which are prescribed for the model 22, initially only estimated are iteratively correlated by means of the results of the measurements with the actually momentarily given physical behavior along the ballistic trajectory B.

Thus, along the ballistic trajectory B on the way towards the apogee A, there is effected a predictive correction of the mathematical description of the trajectory B obtained from a physical model or from experimentations, which will finally quite closely conform with the ballistic trajectory B actually traversed by the projectile 12 under consideration of all external influences; such that from these, there can be iteratively determined the actual conditions for a certain fluctuation dx in a measured value, correlated model 22 with an extrapolator 26 for the timepoint ta of the apogee associated with the geometry of the trajectory B (looking back in time or estimating forwardly) as the timepoint t(dx=0).

Since, as represented, different timepoints ta of the apogee can be determined from different measured values x, the extrapolators 26 which are associated with the individual measured values x have a selector circuit 27 expediently connected to the output thereof. In this circuit, pursuant to the criteria of mathematical statistics (for example, in the way of a median value formation), there are evaluated the individually obtained timepoints tax, so as to finally provide a timepoint ta for the apogee which is significant for the further functioning of the autopilot.

When for a special case of utilization, the altitude ha of the apogee is of interest, then this can also be computed, from the physical relationships of the logarithmetic extent of the barometric pressure p along the ballistic trajectory B without necessitating for this purpose any absolute pressure information (such as at the firing locale). This facilitates a further precision in the determination of the change-over timepoint tu from the measured value x=p which is exclusively obtained on board the projectile 12.

Figure 3:
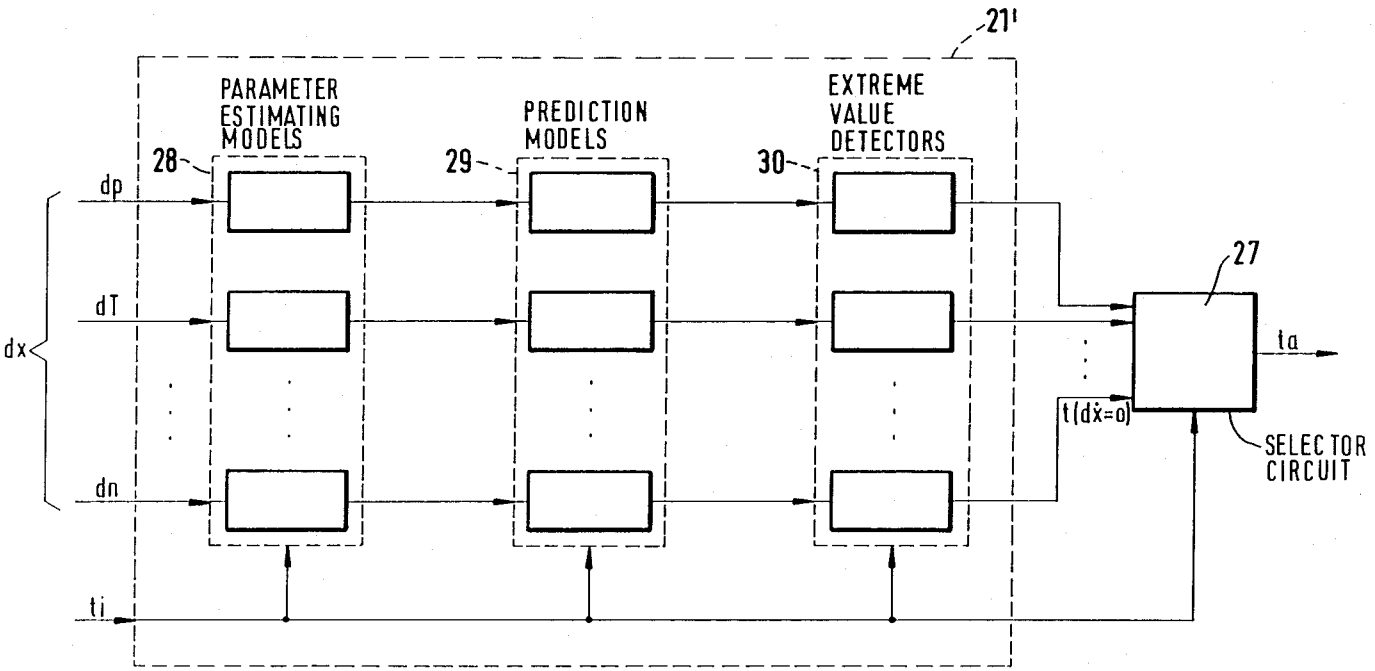
FIG. 3 illustrates a circuit for the detection of the apogee, which is modified with respect to that shown in FIG. 2.

The modified computer circuit 21' for the detection of the apogee from the individually determined changes dx in the measured values, as illustrated in FIG. 3, should clarify the sequence of the model approximation. Measured value gradients dx are supplied to individual parameter-estimating models 28, in which the latter (as mentioned hereinabove) do not relate to linear condition models pertaining to the behavior of the gradients of the applicable measured values; for example, the pressure gradient dp, the temperature gradient dT, and the pitch-rotational rate gradient dn over presently the relative time di. The values which are emitted from these non-linear models represent the estimated model parameters, with which there are supplied prediction models 29 for the forecast of the sequence overtime for the mentioned measured value-gradients dx. From these predicted time cycles, there is presently determined, by means of extreme value detectors 30, at which relative point in time there is present the decisive extremity of the applicable time cycles, and a decision logic in the form of a selector circuit 27 delivers the sought for apogee timepoint ta, somewhat as from a median value formation with respect to the individual extreme value timepoints or from statistical considerations pertaining to their distribution (for example, in accordance with the socalled Chi-Test); such as through the determination of a representative time value ta from the dispersion of the individual values.

What is claimed is:

1. A method for the on board determination of the passage by a ballistically launched projectile through the apogee of a trajectory through the receipt and comparison of a sequence of measured values fluctuating specifically relative to the trajectory; comprising repeatedly determining changes in trajectory-dependent environmental or system measured values upon said projectile reaching a stable condition of flight along said trajectory; comparing the change in the measured values with predicted changes obtained from a mathematic-parametric model of the behavior of said projectile; correlating the parameters of the model on the basis of the actual development of the measured values with the actual movement of said projectile; and computing the point in time of the passage through the apogee of the ballistic trajectory from the model with recursively correlated parameters.

2. A method as claimed in claim 1, wherein the recursive correlation of parameters is obtained from different changes in the measured values.

3. A method as claimed in claim 1, wherein one of said measured values comprises the barometric pressure in the surroundings about the projectile.

4. A method according to claim 1, wherein one of said measured values comprises the temperature of the medium surrounding the projectile.

5. A method as claimed in claim 1, wherein one of the measured values comprises the pitch rotational rate determined on board the projectile.

6. An arrangement for the on board determination of the point in time of the passage of a projectile launched in a ballistic trajectory through the apogee of said trajectory by the receipt and comparison of a sequence of fluctuating measured values which are specific relative to the trajectory; comprising a computer circuit including a model representative of the expected movement of said projectile along the ballistic trajectory, a polynomial comparator for the evident system parameters of the curve plot of said model; and means for supplying said circuit, with measured values from at least one sensor measuring environmental and system conditions for an adaptive correction of forecast system parameters pursuant to the measure of the actual ballistic-kinematic behavior of said projectile.

7. An arrangement as claimed in claim 6, wherein a differential former is connected to the output of said sensor.

8. An arrangement as claimed in claim 6, comprising a sensor for determining the environmental barometric pressure.

9. An arrangement as claimed in claim 6, comprising a sensor for determining the temperature of the environment.

10. An arrangement as claimed in claim 6, comprising a pitch-rotational rate gyro constituting a sensor for determining the pitch rate of said systems.

* * * * *